US009302267B2

(12) United States Patent
Cascio et al.

(10) Patent No.: US 9,302,267 B2
(45) Date of Patent: Apr. 5, 2016

(54) PICK HOLDER

(75) Inventors: Russell Cascio, Brown Deer, WI (US); Adam Osuski, Random Lake, WI (US); Justin Zunker, Port Washington, WI (US); Bernard Pusheck, Cudahy, WI (US)

(73) Assignee: Harnischfeger Technologies, Inc., Wilmington, DE (US)

( * ) Notice: Subject to any disclaimer, the term of this patent is extended or adjusted under 35 U.S.C. 154(b) by 930 days.

(21) Appl. No.: 13/307,061

(22) Filed: Nov. 30, 2011

(65) Prior Publication Data

US 2012/0132740 A1 May 31, 2012

Related U.S. Application Data

(60) Provisional application No. 61/458,712, filed on Nov. 30, 2010.

(51) Int. Cl.

| | |
|---|---|
| ***B02C 13/28*** | (2006.01) |
| ***B02C 4/08*** | (2006.01) |
| ***B02C 4/30*** | (2006.01) |

(52) U.S. Cl.
CPC ... *B02C 4/08* (2013.01); *B02C 4/30* (2013.01); *B02C 13/28* (2013.01)

(58) Field of Classification Search
CPC ..... B02C 4/02; B02C 13/28; B02C 13/2804; B02C 13/2808; B02C 4/08; B02C 4/30
USPC ..... 241/189.1, 236, 187, 294
See application file for complete search history.

(56) References Cited

U.S. PATENT DOCUMENTS

| | | | |
|---|---|---|---|
| 2,965,365 | A | 12/1960 | Krekeler |
| 3,614,164 | A | 10/1971 | Davis |
| 3,913,979 | A | 10/1975 | Strauss et al. |
| 4,094,611 | A | 6/1978 | Harper et al. |
| 4,163,581 | A | 8/1979 | Krekeler |
| 4,274,677 | A | 6/1981 | Proctor |
| 4,275,929 | A | 6/1981 | Krekeler |
| 4,415,208 | A | 11/1983 | Goyarts |
| 4,557,525 | A | 12/1985 | Merten et al. |
| 4,607,891 | A | 8/1986 | Pendolino et al. |
| 4,650,254 | A | 3/1987 | Wechner |
| 4,733,828 | A | 3/1988 | Potts |

(Continued)

FOREIGN PATENT DOCUMENTS

| | | | |
|---|---|---|---|
| CN | 201279475 | Y | 7/2009 |
| CN | 201380089 | Y | 1/2010 |

(Continued)

OTHER PUBLICATIONS

Chilean Search Report dated Oct. 1, 2013 for Chilean Application No. 1394-2012 (6 pages).

(Continued)

*Primary Examiner* — Mark Rosenbaum
(74) *Attorney, Agent, or Firm* — Michael Best & Friedrich LLP

(57) ABSTRACT

A pick holder for a roll sizer, the roll sizer including at least one roll drum defining a drum axis, the roll drum rotating about the drum axis. The pick holder includes a base and a shoulder. The base includes at least one hole for receiving a fastener for removably coupling the pick holder to the roll drum. The shoulder is coupled to the base.

19 Claims, 8 Drawing Sheets

(56) References Cited

U.S. PATENT DOCUMENTS

| | | | | |
|---|---|---|---|---|
| 4,744,605 | A | 5/1988 | Komotzki | |
| 4,763,845 | A | 8/1988 | Guggenheimer et al. | |
| 4,828,327 | A | 5/1989 | Wechner | |
| 4,913,125 | A | 4/1990 | Bunting et al. | |
| 4,919,566 | A | 4/1990 | Caron et al. | |
| 4,944,560 | A | 7/1990 | Osterwise | |
| 4,946,109 | A | 8/1990 | Lewis | |
| 5,011,229 | A | 4/1991 | O'Neill et al. | |
| 5,441,206 | A | 8/1995 | Schade et al. | |
| 5,769,505 | A | 6/1998 | Siddle et al. | |
| 6,764,140 | B2 | 7/2004 | Carson, Jr. et al. | |
| 7,073,870 | B2 | 7/2006 | Tillessen et al. | |
| D560,232 | S | 1/2008 | De Martiis | |
| D576,183 | S | 9/2008 | De Martiis | |
| D602,505 | S | 10/2009 | Ruvang | |
| 7,694,443 | B2 | 4/2010 | Gabela et al. | |
| 8,020,800 | B2 | 9/2011 | Potts | |
| D682,900 | S | 5/2013 | Parrott | |
| 8,506,019 | B2 | 8/2013 | Monyak et al. | |
| 8,814,073 | B2 * | 8/2014 | Barber | 241/189.1 |
| 2001/0022465 | A1 | 9/2001 | Mondy | |
| 2004/0251360 | A1 | 12/2004 | Everson et al. | |
| 2006/0261202 | A1 * | 11/2006 | Potts | 241/236 |
| 2009/0273225 | A1 | 11/2009 | Hall et al. | |
| 2010/0194176 | A1 | 8/2010 | Lucek et al. | |
| 2012/0068527 | A1 | 3/2012 | Erdmann et al. | |

FOREIGN PATENT DOCUMENTS

| | | | |
|---|---|---|---|
| CN | 101745443 | A | 6/2010 |
| DE | 3833614 | A1 | 4/1990 |
| EP | 0114725 | * | 8/1984 |
| GB | 1266137 | | 3/1972 |
| GB | 1048967 | | 9/1988 |
| WO | 9629149 | A1 | 9/1996 |
| WO | 99/54049 | | 10/1999 |
| WO | 2004/018106 | | 3/2004 |

OTHER PUBLICATIONS

Co-pending Design U.S. Appl. No. 29/407,489, filed Nov. 30, 2011.
Co-pending Design U.S. Appl. No. 29/407,487, filed Nov. 30, 2011.
Australian Patent Examination Report No. 1 for Australian Application No. 2011253666 dated Nov. 1, 2013 (4 pages).
English translation of First Office Action from the State Intellectual Property Office of the People's Republic of China dated Oct. 20, 2014 (15 pages).

* cited by examiner

PICK HOLDER

BACKGROUND

The present invention relates to the field of mining crushers. Specifically, the present invention discloses a roll assembly for a crusher.

Conventional mining crushers include a pair of parallel roll assemblies rotating in opposite directions. The rolls include a series of picks arranged along the surface. As the rolls rotate, the picks engage material that is dropped onto the top of the rolls. The picks break apart the material. During normal operation, it is possible for a tramp event to occur, in which a very dense or very hard material is inserted into the crusher. In this case, the resulting stresses are very high and can cause one or more picks to fail. When the picks fail, it is necessary to disassemble the roll assembly to replace the broken pick. Disassembly often requires uninstalling the entire roll assembly from the roll sizer frame. In addition, since the picks are often stacked in an axial arrangement on the roll, repair of the broken pick requires removing all of the picks in order to remove the broken pick. This complicated process can render the crusher inoperable for long periods of time, reducing productivity.

SUMMARY

In one embodiment, the invention provides pick holder for a roll sizer, the roll sizer including at least one roll drum defining a drum axis, the roll drum rotating about the drum axis. The pick holder includes a base and a shoulder. The base includes at least one hole for receiving a fastener for removably coupling the pick holder to the roll drum. The shoulder is coupled to the base.

In another embodiment, the invention provides a pick assembly for a roll sizer, the roll sizer including at least one roll drum defining a drum axis, the pick assembly including a pick holder and a pick. The pick holder is coupled to the roll drum. The pick is removably coupled to the pick holder and includes a head and a shaft. The head has a tip for engaging material to be broken apart. The shaft has a first end and a second end and defines a pick axis therebetween, the first end being coupled to the head opposite the tip.

In yet another embodiment, the invention provides a roll assembly including a shaft, a roll drum, and a plurality of pick holders. The shaft defines a shaft axis and is rotatable in a first direction. The roll drum is removably coupled to the shaft and defines an outer surface. The roll drum includes a plurality of lugs coupled to the outer surface. Each pick holder includes a base removably coupled to one of the lugs.

In still another embodiment, the invention provides an apparatus in a mining crusher, the apparatus including a roll drum, a pick holder, and a means for removably coupling the pick holder to the roll drum. The roll drum defines a drum axis and rotates in a first direction about the drum axis. The pick holder includes a base and a shoulder. The base is removably coupled to the roll drum and the shoulder includes a recess.

In yet another embodiment, the invention provides a roll sizer for a mining crusher. The roll sizer includes a first shaft, a second shaft, a first roll assembly, and a second roll assembly. The first shaft defines a first axis and rotates in a first direction. The second shaft defines a second axis and rotates in a second direction opposite the first direction. The first roll assembly includes a first roll drum having a plurality of lugs, a plurality of pick holders, and a plurality of picks. The first roll drum is rotatably coupled to the first shaft. Each of the pick holders are removably coupled to one of the lugs, and each of the picks are removably coupled to one of the pick holders such that the picks are oriented substantially perpendicular to the first axis. The second roll assembly includes a second roll drum having a plurality of lugs, a plurality of pick holders, and a plurality of picks. The second roll drum is rotatably coupled to the second shaft. Each of the pick holders are removably coupled to one of the lugs, and each of the picks re removably coupled to one of the pick holders such that the picks are oriented substantially perpendicular to the second axis.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Unless specified or limited otherwise, the terms "mounted," "connected," "supported," and "coupled" and variations thereof are used broadly and encompass both direct and indirect mountings, connections, supports, and couplings.

Figure 1:
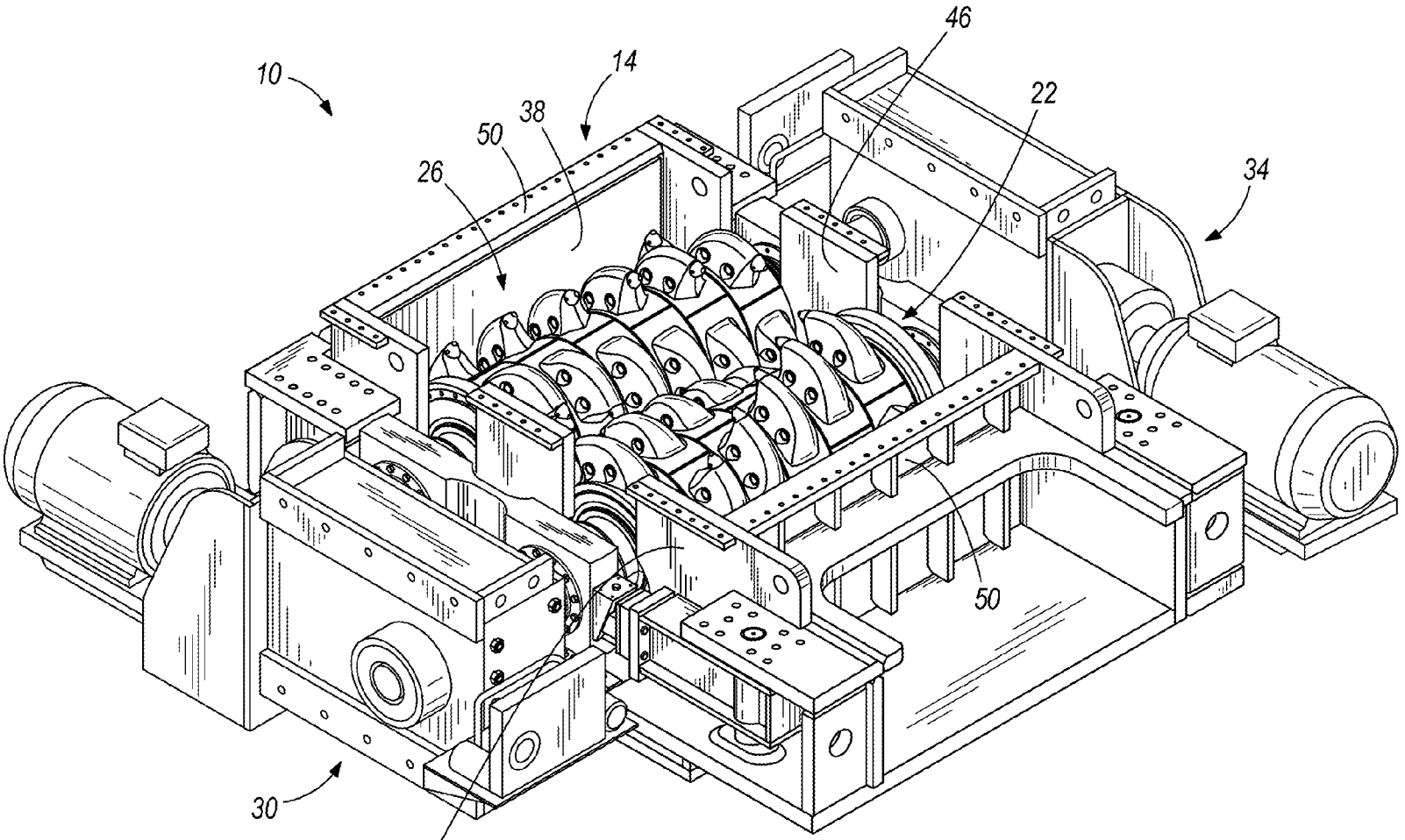
FIG. 1 is a perspective view of a roll sizer according to one embodiment of the present invention.

As shown in FIG. 1, a roll sizer 10 for a mobile mining crusher includes a frame 14, a first roll assembly 22, a second roll assembly 26, a first drive assembly 30 for rotating the first roll assembly 22, and a second drive assembly 34 for rotating the second roll assembly 26. The frame 14 defines a crushing chamber 38. In the illustrated embodiment, the crushing chamber 38 has a rectangular shape defined by a pair of support walls 46 and a pair of connecting walls 50 extending between the supports walls 46.

Figure 2:
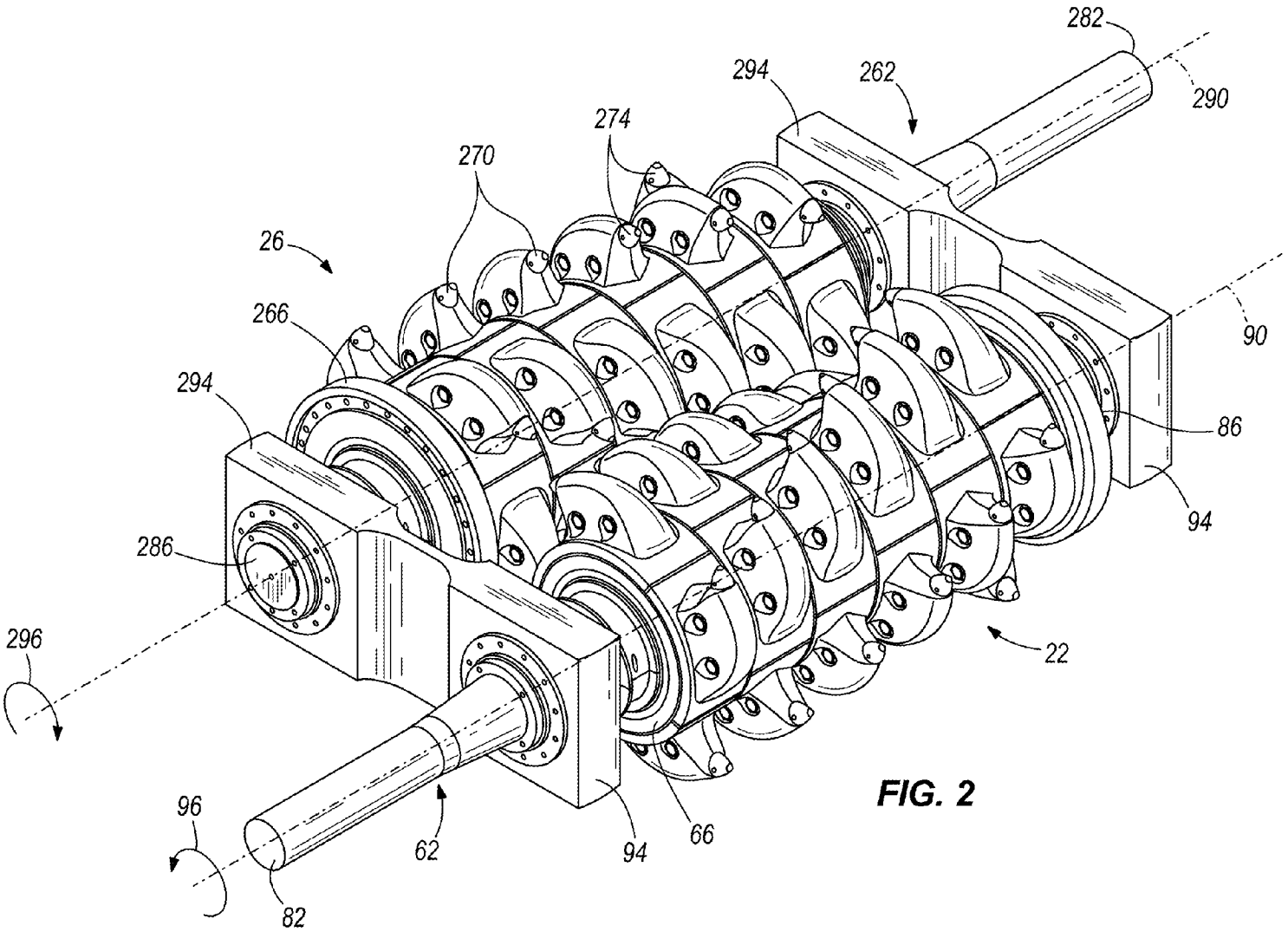
FIG. 2 is a perspective view of a first roll assembly and second roll assembly of the roll sizer of FIG. 1.
Figure 3:
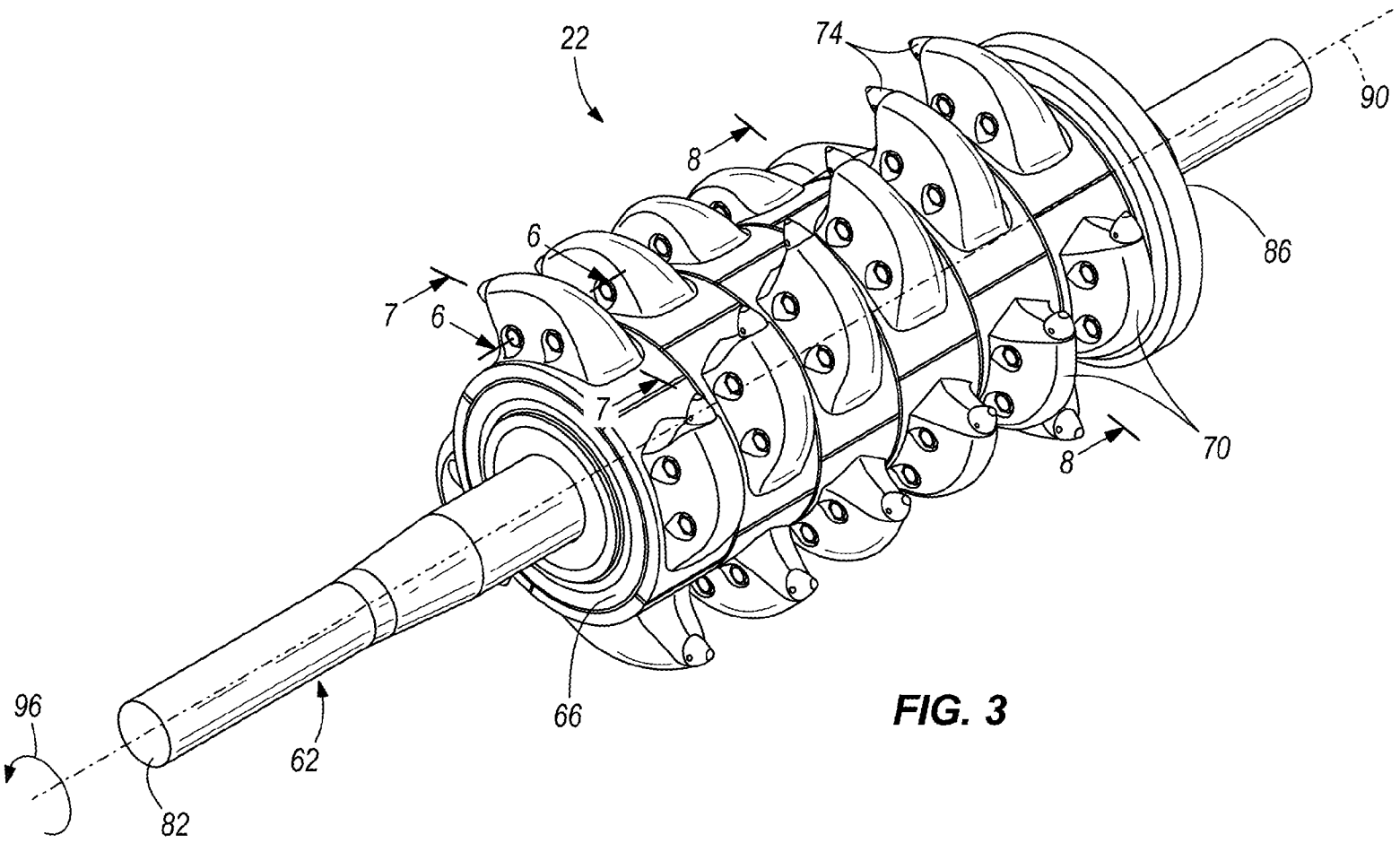
FIG. 3 is a perspective view of the first roll assembly of FIG. 2.

As shown in FIG. 3, the first roll assembly 22 includes a first shaft 62, a roll drum 66 (FIG. 4), multiple holders 70, and multiple picks 74. The first shaft 62 includes a first end 82 and a second end 86 and defines a first axis 90 therebetween. As used herein, the term "radial" and variants thereof refer to a direction that is perpendicular to the first axis 90, while the term "axial" and variants thereof refer to a direction that is parallel to the first axis 90. The first end 82 is coupled to the first drive assembly 30 (FIG. 1), which rotates the first roll assembly 22 about the first axis 90 in a first direction 96. The first shaft 62 is rotatably supported by a pair of first shaft supports 94 (FIG. 2).

Figure 4:
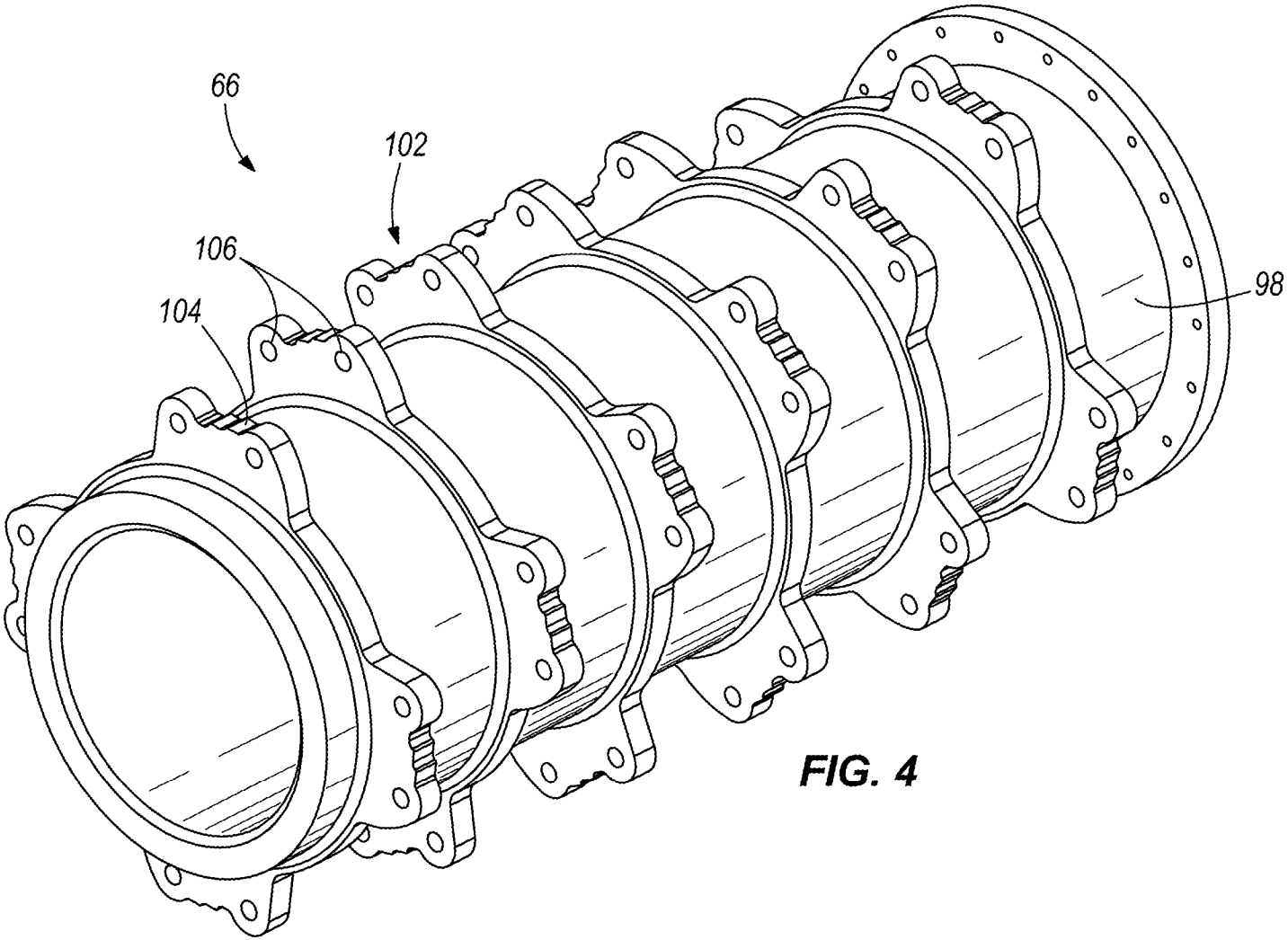
FIG. 4 is a perspective view of a roll drum.

As shown in FIG. 4, the roll drum 66 is removably coupled to the first shaft 62. In the illustrated embodiment, the roll drum 66 is rotatably coupled to the first shaft 62 with a locking ring (not shown). In other embodiments, other means for removably coupling the roll drum 66 and the first shaft 62 may be used, including bolting. The roll drum 66 defines an outer surface 98 and includes multiple lugs 102 arranged along the length and the perimeter of the outer surface 98. The lugs 102 are cast integrally with the roll drum 66. In other embodiments, the lugs 102 may be attached to the roll drum 66 by another method, such as by welding or a bolted joint connection.

Figure 5:
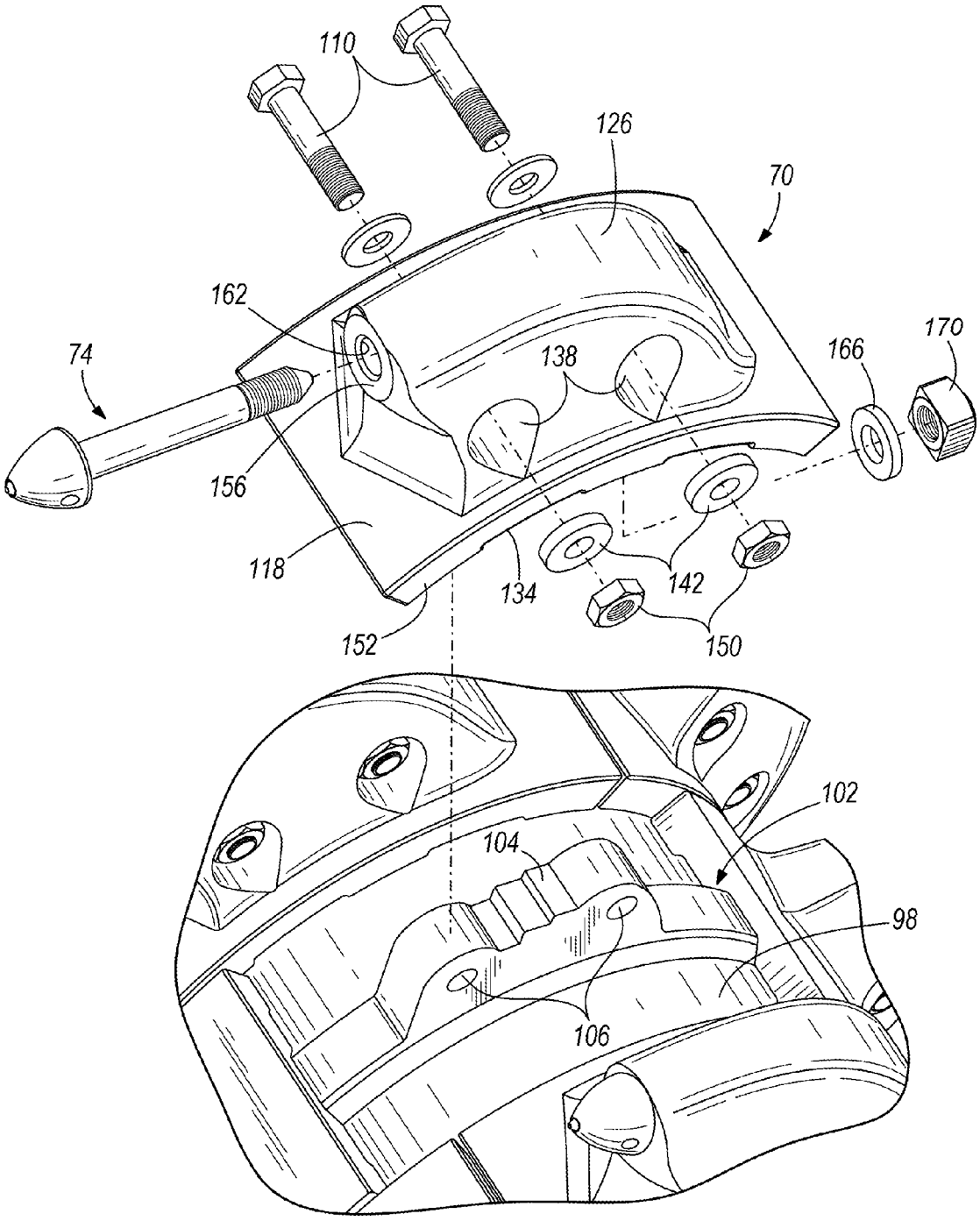
FIG. 5 is an exploded view of a portion of the first roll assembly of FIG. 3.

Referring to FIGS. 4 and 5, each lug 102 includes a top surface 104 and two holes 106 extending through the lug 102 for receiving fasteners 110. The two holes 106 extend in a direction that is substantially parallel to the first axis 90 (FIG. 3) and substantially transverse to the first direction of rotation 96 (FIG. 3). In the illustrated embodiment, the roll drum 66 has a cylindrical shape and four lugs 102 are arranged in 90° intervals around the perimeter of the roll drum 66 (see also FIG. 8). The roll drum 66 includes six sets of lugs 102 spaced along the length of the roll drum 66. At an adjacent axial position, the lugs 102 are arranged in 90° intervals around the perimeter but are offset from the adjacent set of lugs 102 by approximately 15°. This provides a staggered arrangement for the picks 74 (FIG. 3) and aids in breaking apart material in the roll sizer 10 (FIG. 1). The arrangement of the picks 74 is described in further detail below. In other embodiments, fewer or more lugs 102 may be positioned around each portion of the roll drum 66, and the amount of offset may be more or less than that shown in the illustrated embodiment. In other embodiments, the lugs 102 may include more or fewer holes 106.

Figure 6:
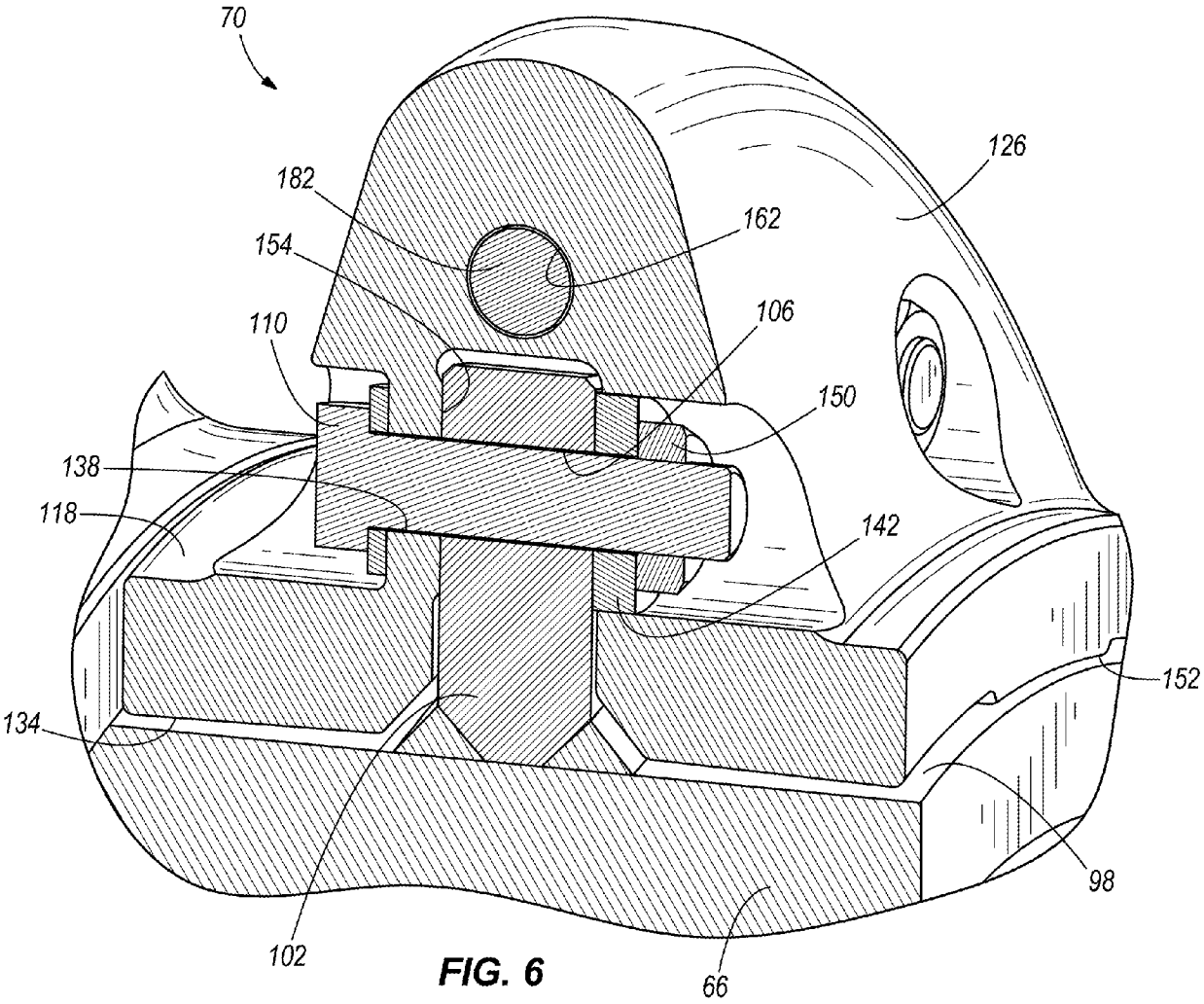
FIG. 6 is a section view of the roll assembly of FIG. 3 taken along line 6-6.

As shown in FIGS. 5 and 6, each holder 70 includes a base 118 and a shoulder 126. The base removably couples the holder 70 to one of the lugs 102. In the illustrated embodiment, the base 118 and shoulder 126 are formed as a unitary piece and are composed of cast alloy steel or cast manganese, with certain features being machined in the holder 70. The base 118 includes a lower surface 134, two holes 138, two bearing spacers 142, two fasteners 110, and two retaining nuts 150. In other embodiments, the base 118 may be formed form a different material, may include fewer or more fasteners 110 and holes 138, or may be coupled to the lugs 102 in another manner. The lower surface 134 is adjacent the outer surface 98 of the roll drum 66. The lower surface 134 defines an arcuate profile that aligns with the outer surface 98 of the roll drum 66 when the holder 70 is coupled to the lug 102. The lower surface 134 includes a portion 152 proximate the outer surface 98.

Referring to FIGS. 5 and 6, each hole 138 extends transversely through the shoulder 126 and is aligned with the holes 106 of the lug 102. Each hole 138 includes a machined surface 154 (FIG. 6) adjacent either end of the hole 138. Each hole 138 extends in a direction that is substantially parallel to the first axis 90 (FIG. 3) and substantially transverse to the first direction of rotation 96 (FIG. 3) of the roll assembly 22. Each fastener 110 extends through the hole 138 and through each respective lug hole 106 from one side to the other side and is secured by one of the retaining nuts 150. The fasteners 110 therefore experience a shear load due to the crushing force of the pick 74 exerted on the material in the crushing chamber 38. The bearing spacers 142 are inserted between the retaining nuts 150 and the lug 102, increasing the contact area between the nut 150 and the lug 102. Tightening each fastener 110 increases the compressive force on the lug 102 and the holder 70. The compressive force provides frictional and bearing reaction forces for resisting the crushing force of the pick 74, reducing the shear force on the fasteners 110 and improving the life of the fasteners 110. The lug 102, fasteners 110, and retaining nuts 150 form a means for removably coupling the pick holder 70 to the roll drum 66.

Figure 7:
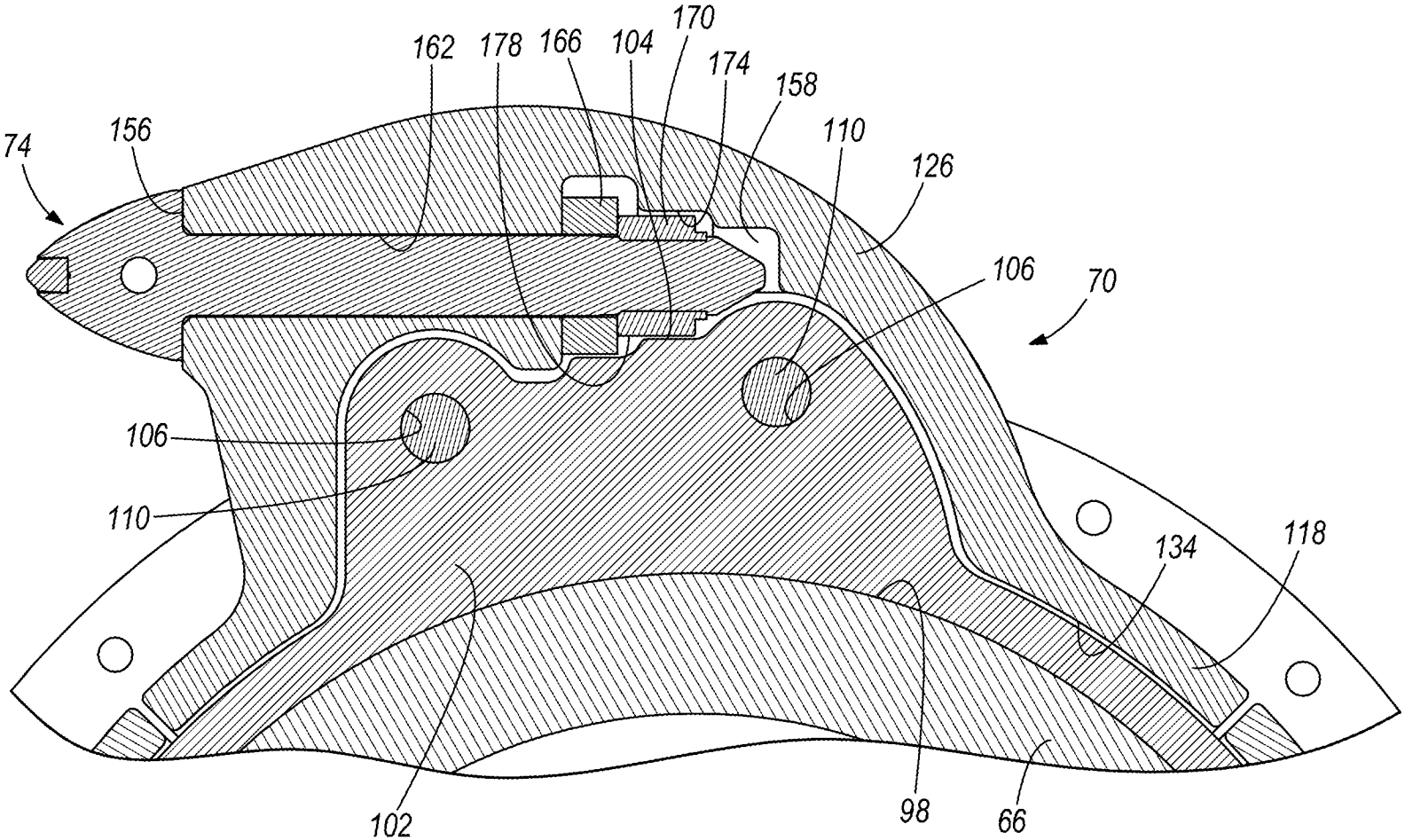
FIG. 7 is a section view of the roll assembly of FIG. 3 taken along line 7-7.

In the embodiment illustrated in FIGS. 5 and 7, the shoulder 126 has an arcuate profile extending toward the base 118 on a side facing away from the direction of rotation 96. In other embodiments, the shoulder 126 may have a different shape. The shoulder 126 includes a seat 156, a recess 158 (FIG. 7) within the holder 70, a bore 162 extending between the seat 156 and the recess 158, a washer 166 (FIG. 7), and a lock nut 170 (FIG. 7) positioned within the recess 158. The seat 156 defines a generally flat surface that is oriented to substantially face toward the direction of rotation 96 of the roll drum 66 about the first axis 90. The recess 158 is positioned within the holder 70 and away from the seat 156. In the illustrated embodiment, the recess 158 is enclosed within the holder 70 and includes a profile that aligns with the shape of the lug 102. In other embodiments, the recess 158 may not be entirely enclosed by the holder 70, and may have a different profile. The recess 158 defines an interior wall 174 (FIG. 7).

Figure 8:
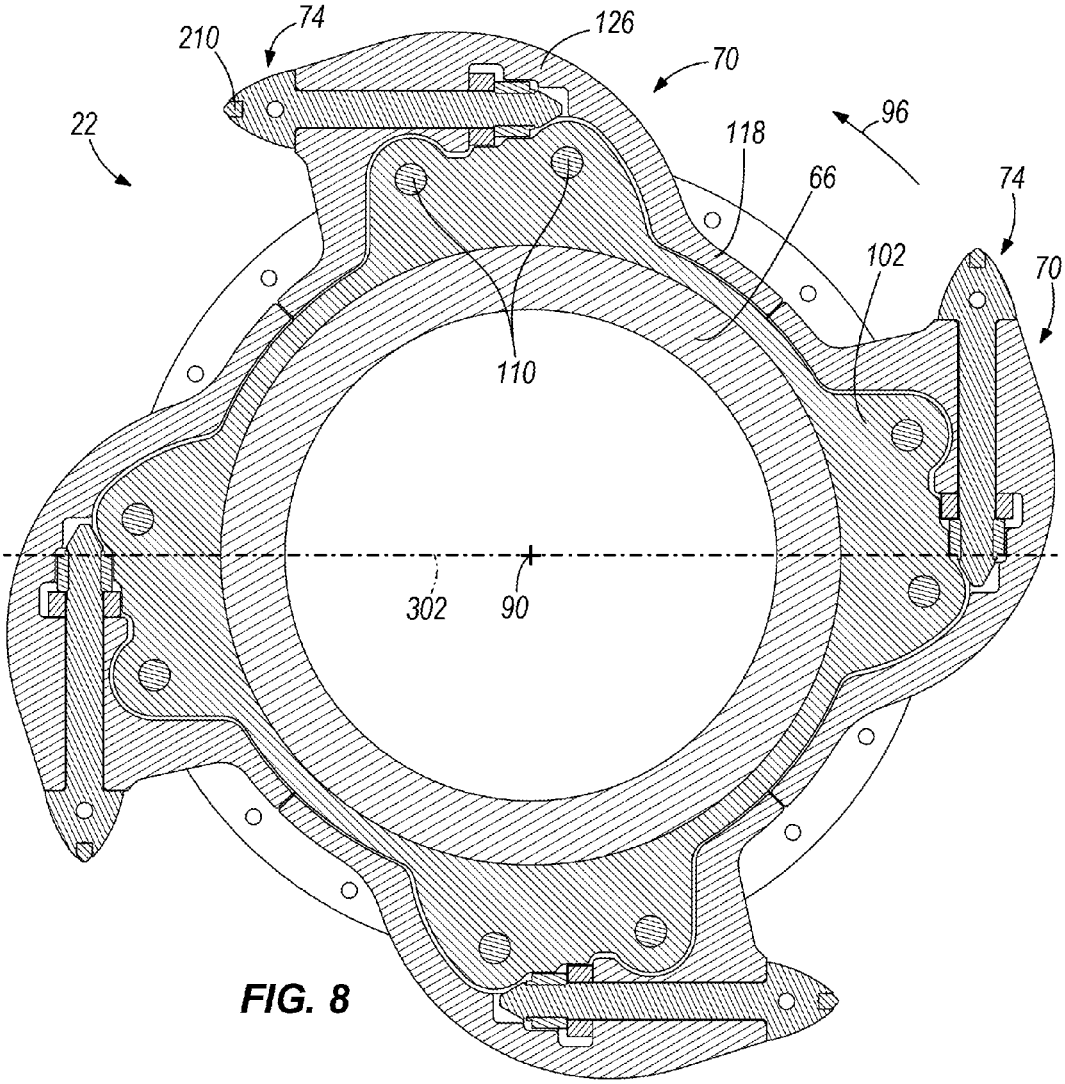
FIG. 8 is a section view of the roll assembly of FIG. 3 taken along line 8-8.

As shown in FIGS. 7 and 8, the bore 162 is oriented in a direction that is substantially perpendicular to the first axis 90 (FIG. 8), and substantially parallel to the first direction of rotation 96 (FIG. 8). The washer 166 is positioned between the lock nut 170 and the bore 162. In an alternative embodiment, the washer 166 may be composed of an elastomeric, shock-absorbent material in order to maintain a desired preload on the pick 74. The lock nut 170 has at least one side 178 abutting the interior wall 174 and/or a top surface 104 of the lug 102, securing the lock nut 170 against rotation and preventing the nut 170 from loosening within the recess 158. In the illustrated embodiment, the lock nut 170 has a generally square shape and is separate from the holder 70. In other embodiments, the lock nut 170 is welded within the recess 158, or is formed as a part of the holder 70 within the recess 158.

Figure 9:
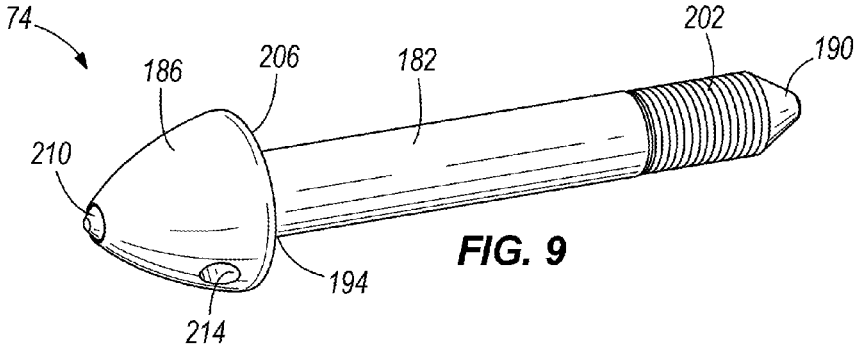
FIG. 9 is a perspective view of a pick.

As shown in FIG. 9, each pick 74 includes a shaft 182 and a head 186 coupled to the shaft 182. The shaft 182 includes a first end 190 and a second end 194. The first end 190 of the shaft 182 includes a threaded portion 202 for engaging the lock nut 170. The shaft 182 is received within the bore 162 such that the threaded portion 202 is positioned within the recess 158. The head 186 is coupled to the second end 194 of the shaft 182 and includes a back portion 206, a tip 210, and a hole 214. The back portion 206 abuts the seat 156 when the pick 74 is mounted within the holder 70. In one embodiment, the tip 210 is made from a carbide material having a high hardness. When the pick 74 is secured within the holder 70, the tip 210 is oriented to point in a direction that is substantially parallel to the first direction 96 and substantially perpendicular to the first axis 90. The hole 214 extends through the head 186 in a transverse direction, and is adapted to receive a wrench or other tool for applying a torque to the pick 74 to screw or unscrew the threaded portion 202 in the lock nut 170.

Referring to FIG. 2, the second roll assembly 26 is similar to the first roll assembly 22 described in detail above. The second roll assembly 26 includes a second shaft 262, a roll drum 266, multiple holders 270, and multiple picks 274. The second shaft 262 includes a first end 282 and a second end 286 and defines a second axis 290 therebetween that is parallel to the first axis 90. The first end 282 is coupled to the second drive assembly 34 (FIG. 1), which rotates the second roll assembly 26 about the second axis 290 in a second direction 296. The second shaft 262 is rotatably supported by a pair of second shaft supports 294. The roll drum 266, holders 270, and picks 274 of the second roll assembly 26 are similar to the components of the first roll assembly 22 described above.

As shown in FIG. 2, the first shaft 62 and the second shaft 262 are counter-rotating, such that the first roll assembly 22 and the second roll assembly 26 rotate in opposite directions when viewed from a common side. Stated another way, the holders 70, 270 of each roll assembly 22, 26 pass over the top of each axis 90, 290 and rotate toward one another. In the embodiment illustrated in FIG. 2, as viewed along each axis 90, 290 from the first end 82 of the first shaft 62 and the second end 286 of the second shaft 262, the first roll assembly 22 rotates in the first direction 96 (counter-clockwise) and the second roll assembly 26 rotates in the second direction 296 (clockwise). As the first roll assembly 22 and the second roll assembly 26 rotate, the holders 70 of the first roll assembly 22 pass between the holders 270 of the second roll assembly 26 without contacting one another. In the illustrated embodiment, the first axis 90 and the second axis 290 define a sizer plane 302 (FIG. 8).

To assemble the roll assembly 22, the roll drum 66 is removably coupled to the first shaft 62 by, for example, the locking ring. The washer 166 and the security nut 170 are inserted within the recess 158, and the threaded portion 202 of the pick shaft 182 is inserted through the bore 162 to engage the lock nut 170. A tool rotates the head 186 by applying a torque at the hole 214, and the pick 74 is tightened within the holder 70 until a desired pre-load on the pick 74 is applied. The holder 70 and pick 74 are then positioned on the roll drum 66 such that the holes 138 of the holder base 118 are aligned with the holes 106 on the lug 102 of the roll drum 66. The fasteners 110 are then passed though each lug hole 106 from one side of the holder 70 and secured by the bearing spacers 142 and retaining nuts 150 on the opposite side of the holder 70. Tightening the retaining nuts 150 creates a compressive load on the base 118 of the holder 70 between the bearing spacers 142 and the machined surface of the lug 102.

During operation of the roll sizer 10, the crushing chamber 38 receives material from, for example, a conveyor (not shown) on one side of the sizer plane 302. Pieces of the material are urged toward a position between the first roll assembly 22 and the second roll assembly 26. As shown in FIG. 8, the picks 74 of the first roll assembly 22 are oriented to exert a crushing force on the material. The material is trapped between the picks 74, 274 of each roll assembly 22, 26, causing the material to exert a reaction force on the picks 74, 274 and the holders 70, 270.

The reaction force acts against the crushing force, creating a shear load on the fasteners 110, the lug 102, the holder 70, and the spacers 142. The compressive load on the base 118 of the holder 70 creates friction between the holder 70 and the lug 102, which resists the reaction force and reduces the shear load on the fasteners 110. The picks 74 pierce and break apart the material to a desirable size. The material then falls between the first roll assembly 22 and the second roll assembly 26, passing to the other side of the sizer plane 302 and out of the crushing chamber 38. The crushing forces generated by the picks 74 vary significantly depending on the application, the size of the material, the spacing of the roll assemblies 22, 26, and other factors.

In the event a piece of hard, dense material, or tramp material, is fed into the crushing chamber 38, the crushing forces may cause one or more holders 70, picks 74, or lugs 102 to fail. The modular design of the first roll assembly 22 permits the operator to remove and replace a broken pick 74 without requiring the operator to uninstall the holder 70 from the roll drum 66. In addition, the compressive force of the bearing spacers 142 provides friction between the lug 102 and the holder 70 to resist the reaction forces that develop when the picks 74 exert a crushing force on the material in the crushing chamber 38. This friction reduces the shear load on the fasteners 110, holder 70, lug 102, and spacers 142, thereby improving wear characteristics. In the event a holder 70 or a fastener 110 fails, the method of coupling the holder 70 to the roll drum 66 allows the operator to replace the holder 70 without requiring the entire roll drum 66 to be uninstalled from the roll assembly 22. Furthermore, replacement lugs 102 may be coupled, such as by welding, to the roll drum 66 in case the lugs 102 are damaged. These features incorporate multiple failure modes into the roll assembly 22, reducing the maintenance time required for the roll sizer 10 and improving the operating time of the machine.

Thus, the invention provides, among other things, a pick holder. Various features and advantages of the invention are set forth in the following claims.

What is claimed is:

1. A pick assembly for a roll sizer, the roll sizer including at least one roll drum defining a drum axis, the pick assembly comprising:

a pick holder including a base having a first side, a second side, and a pair of holes extending between the first side and the second side, each hole receiving a fastener configured to directly secure the pick holder to the roll drum independent of any adjacent pick holder, the pick holder further including a seat, a recess, and a bore extending between the seat and the recess; and a pick removably coupled to the pick holder, the pick including a head and a shaft, the head having a tip for engaging material to be broken apart, the shaft having a first end and a second end and defining a pick axis therebetween, the first end being coupled to the head opposite the tip, the pick head abutting the seat and the shaft being received within the bore such that the second end of the shaft is positioned within the recess.

2. The pick assembly of claim 1, wherein each hole defines a hole axis configured to be parallel to the drum axis.

3. The pick assembly of claim 1, wherein the second end of the pick includes a threaded portion, and the threaded portion is removably coupled within the recess by a lock nut.

4. The pick assembly of claim 3, wherein the lock nut includes an outer surface configured to abut a surface of a lug coupled to the roll drum and prevent rotation of the lock nut.

5. The pick assembly of claim 1, wherein the bore is configured to be oriented substantially perpendicular to the drum axis.

6. The pick assembly of claim 1, the pick head further including a hole extending transverse to the pick axis, the hole receiving a tool for installing the pick.

7. The pick assembly of claim 1, wherein the pick holder is spaced apart from an adjacent pick holder.

8. The pick assembly of claim 1, wherein the bore of the holder extends at least partially past an outer circumference of the pair of holes of the holder.

9. The pick assembly of claim 1, wherein the holder further includes a base having a lower surface positioned adjacent an outer surface of the roll drum, wherein the pair of holes is positioned between the lower surface and the bore of the holder.

10. A pick assembly for a roll sizer, the roll sizer including at least one roll drum rotatable about a drum axis and including at least one lug, the pick assembly comprising:

a holder configured to be removably coupled to the lug, the holder including a bore, a first side, a second side, and at least one hole extending through the first side and the second side, the hole oriented in a direction parallel to the drum axis, the holder configured to receive the lug between the first side and the second side such that the hole is aligned with at least one hole of the lug, the holder defining an external surface having a seat and an internal recess, the bore extending between the seat and the internal recess;

a fastener extending through the hole of the holder and through the lug to removably couple the holder directly to the roll drum; and an elongated pick removably coupled to the holder, the pick defining a first end and a second end and a pick axis extending therebetween, the pick including a head proximate the first end and a shaft extending from the head to the second end, the head having a tip for engaging material to be broken apart, the shaft being received within the bore of the holder, the pick head abutting the seat and the second end of the pick being releasably secured in the internal recess.

11. The pick assembly of claim 10, wherein a portion of the shaft proximate the second end includes a threaded portion, and the threaded portion engages a nut positioned within the internal recess.

12. The pick assembly of claim 11, wherein the lock nut includes an outer surface configured to abut a surface of a lug coupled to the roll drum and prevent rotation of the lock nut.

13. The pick assembly of claim 11, wherein the nut is separate from the pick holder such that the nut can be removed from the internal recess when the pick is uncoupled from the holder.

14. The pick assembly of claim 10, wherein the pick axis is oriented substantially perpendicular to the drum axis.

15. The pick assembly of claim 10, wherein the pick head further includes a hole extending transverse to the pick axis, the hole receiving a tool for installing the pick.

16. The pick assembly of claim 10, further comprising a nut for threadably engaging the fastener, wherein tightening the nut exerts a compressive force on the lug in a direction transverse to the pick axis.

17. The pick assembly of claim 10, wherein the holder includes two holes extending parallel to the drum axis, and further comprising a second fastener received in one of the holes and configured to engage the lug.

18. The pick assembly of claim 10, wherein the holder is coupled to the lug independent of any other pick holder.

19. The pick assembly of claim 10, wherein the holder further includes a base having a lower surface positioned adjacent an outer surface of the roll drum, wherein the pair of holes is positioned between the lower surface and the bore of the holder.

* * * * *